US006860658B2

(12) United States Patent
Tischer

(10) Patent No.: US 6,860,658 B2
(45) Date of Patent: Mar. 1, 2005

(54) RIBBON WIPER

(75) Inventor: William D. Tischer, Shoreview, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 90 days.

(21) Appl. No.: 10/077,685

(22) Filed: Feb. 15, 2002

(65) Prior Publication Data

US 2003/0156877 A1 Aug. 21, 2003

(51) Int. Cl.[7] ..... B41J 15/10

(52) U.S. Cl. ..... 400/207; 400/208; 347/171; 347/179

(58) Field of Search ..... 400/207, 208, 400/208.1, 217.1, 223; 347/171, 179

(56) References Cited

U.S. PATENT DOCUMENTS

| | | | | |
|---|---|---|---|---|
| 4,970,551 A | * | 11/1990 | Moore | 399/155 |
| 5,078,523 A | | 1/1992 | McGourty et al. | 400/613 |
| 5,138,341 A | | 8/1992 | Kobayashi | 346/136 |

(List continued on next page.)

FOREIGN PATENT DOCUMENTS

| | | | | |
|---|---|---|---|---|
| JP | 03207072 A | * | 9/1991 | G11B/23/50 |
| JP | 04221669 A | * | 8/1992 | B41J/32/00 |
| JP | 05266633 A | * | 10/1993 | G11B/23/50 |

OTHER PUBLICATIONS

Brochure—Brady® Make–It–Yourself Products, It's Important to use the Right Tool for the Right Job, Brady Worldwide, Inc., 1999.

Brochure—Brady® Graphic Solutions, GraphicsPro™ Label & Sign Creator Offers the Convenience of Custom Labels and Signs at the Touch of a Fingertip, W.H. Brady Co./Brady USA, Inc., 1997.

Brochure—Impressa 2 digital label & decal press, Print and Cut Your Own Full–Color Labels and Decals in any Size or Shape!, pp. 1–6, Primera Technology, Inc., 1998.

Brochure—ColorCAMM PRO Versatility, Roland DGA Corporation, 2000.

Brochure—The Future of Sign Making is here, Gerber Edge, Gerber Scientific Products, Inc., 1994.

*Primary Examiner*—Andrew H. Hirshfeld
*Assistant Examiner*—Dave A. Ghatt
(74) *Attorney, Agent, or Firm*—Whyte Hirschboeck Dudek SC

(57) ABSTRACT

Disclosed herein is a ribbon wiper that is disposed within a ribbon cartridge. The ribbon cartridge can contain a ribbon and be employed by a thermal printer. The ribbon wiper is capable of removing debris and other contaminants from a printhead surface of the ribbon. The printhead surface of the ribbon is that surface that faces the printhead, and opposes the ink surface of the ribbon, during printing. Debris disposed on the printhead surface of the ribbon can hinder or obstruct thermal contact between one or more thermal elements on the thermal printhead. In such cases, the thermal element can lack the ability to properly produce a dot on a media as instructed by the thermal printer. Further, debris disposed on the printhead surface of the ribbon can accumulate on the printhead proximate thermal elements and prevent generation of multiple or consecutive dots. If the collection of debris continues, thermal elements can ultimately be disabled causing voids, streaks, and scratches to undesirably appear in a printed image. Ribbon rollers can bias the ribbon toward, and upon, the ribbon wiper. Also, ribbon rollers, as well as a take-up roller, can supply tension to the ribbon to urge the ribbon toward, and upon, the ribbon wiper. Further, the ribbon wiper can be replaced simultaneously with the ribbon cartridge when the supply of ribbon within the ribbon cartridge is exhausted.

20 Claims, 5 Drawing Sheets

U.S. PATENT DOCUMENTS

| | | | | | |
|---|---|---|---|---|---|
| 5,157,761 | A | | 10/1992 | Hawkes | 365/107 |
| 5,163,675 | A | | 11/1992 | Sunohara | 271/274 |
| 5,188,009 | A | | 2/1993 | Sunohara et al. | 83/13 |
| 5,202,958 | A | | 4/1993 | Kobayashi | 395/102 |
| 5,275,077 | A | | 1/1994 | Kobayashi | 83/880 |
| 5,318,370 | A | | 6/1994 | Nehowig | 400/613 |
| 5,401,108 | A | * | 3/1995 | Debreczenyi | 400/202.4 |
| 5,511,891 | A | | 4/1996 | Nehowig et al. | 400/583 |
| 5,755,519 | A | | 5/1998 | Klinefelter | 400/249 |
| 5,823,689 | A | | 10/1998 | Nehowig et al. | 400/83 |
| 5,823,692 | A | | 10/1998 | Tolrud et al. | 400/582 |
| 5,859,755 | A | * | 1/1999 | Griffin et al. | 360/128 |
| 5,887,993 | A | | 3/1999 | Nunokawa et al. | 400/208 |
| 6,007,263 | A | | 12/1999 | Imai et al. | 400/693 |
| 6,008,831 | A | | 12/1999 | Nakanishi et al. | 347/195 |
| 6,011,573 | A | * | 1/2000 | Nagahamaya et al. | 347/217 |
| 6,034,705 | A | | 3/2000 | Tolle et al. | 347/195 |
| 6,042,279 | A | | 3/2000 | Ackley | 400/103 |
| 6,046,756 | A | | 4/2000 | Iga et al. | 347/173 |
| 6,089,767 | A | * | 7/2000 | Martinez et al. | 400/208 |
| 6,099,178 | A | | 8/2000 | Spurr et al. | 400/207 |
| 6,112,658 | A | | 9/2000 | Gunther et al. | 101/171 |
| 6,149,325 | A | | 11/2000 | Nunokawa et al. | 400/208 |
| 6,201,256 | B1 | | 3/2001 | Kouchi et al. | 250/559.44 |
| 6,213,659 | B1 | | 4/2001 | Elgee | 400/633 |
| 6,246,050 | B1 | | 6/2001 | Tullis et al. | 250/231.13 |
| 6,249,302 | B1 | | 6/2001 | Sekiya | 347/220 |
| 6,264,296 | B1 | | 7/2001 | Klinefelter et al. | 347/4 |
| 6,264,774 | B1 | | 7/2001 | Lenz et al. | 156/64 |
| 6,266,075 | B1 | | 7/2001 | Feitel et al. | 347/198 |
| D446,544 | S | | 8/2001 | Platner et al. | D18/50 |
| 6,270,858 | B1 | | 8/2001 | Paulson | 427/508 |
| 6,276,849 | B1 | | 8/2001 | Feitel et al. | 400/242 |

* cited by examiner

RIBBON WIPER

BACKGROUND OF THE INVENTION

1. Field of the Invention

The present invention generally relates to a ribbon wiper for cleaning a ribbon in a printer. In one aspect, the invention comprises a ribbon wiper within a ribbon cartridge, the ribbon wiper comprising a cleaning material layer, the ribbon being biased against the cleaning material layer of the ribbon wiper such that a printhead surface of the ribbon is cleaned and debris is inhibited from accumulating on the printhead during printing.

2. Description of the Related Art

A typical thermal printer, such as a label printer-cutter, includes a printhead comprising a linear array of thermal elements. The number of thermal elements in the linear array can vary, with a characteristic printhead employing 1248 thermal elements. Each of the thermal elements produces heat in response to energy supplied by a microcontroller associated with the thermal printer. The microcontroller applies a voltage or current to each of the thermal elements to heat the thermal elements to a level sufficient to transfer dots (i.e., bums, printed dots, etc.) onto a media (e.g., an adhesive-backed substrate with an opposing ink-receiving surface). This is accomplished when a thermally sensitive supply (e.g., ribbon, ink-bearing ribbon, donor ribbon, etc.) comes into thermal contact with the thermal elements while proximate the media. As thermal elements in the linear array are selectively, intermittently fired, a raster line of dots and/or unprinted areas is produced. The media is stepped past the array of thermal elements, in a direction transverse to the array of thermal elements, such that consecutive raster lines are produced on the media.

Unfortunately, debris (e.g., lint, dust, and/or other contaminants) can become disposed on the ribbon used in the thermal printer. This can occur during printing, while the printer is being stored, during shipping of cartridges carrying the ribbon, during manufacturing of the ribbon, as back-coating of the ribbon occurs, and the like. Debris can become especially troublesome if located on the "printhead surface" of the ribbon, the printhead surface being the surface on the ribbon that faces the printhead during thermal contact. If debris is permitted to remain on the printhead surface of the ribbon during thermal printing, the debris can interfere with, hinder, and/or obstruct thermal contact between a thermal element and the ribbon. This can cause the thermal element to misfire such that the thermal element fails to produce a dot, or produces a malformed dot.

Further, debris disposed on the printhead surface of the ribbon can accumulate on the printhead and/or thermal elements as the printer operates. As the accumulation of debris increases, thermal contact between thermal elements proximate the accumulation of debris and the ribbon can diminish. As debris continues to collect, the compilation of debris can effectively disable a thermal element such that the thermal element is no longer able to generate dots on the media. Thus, multiple, sequential and/or consecutive dots can fail to be generated on a media during thermal contact. In such cases, entire rows, as opposed to individual dots, can be malformed or unintentionally omitted from a printed image. Thus, undesired and unaesthetic "voids", "streaks", and/or "scratches" can occur within the printed image in the direction of printing. These voids can be especially apparent on polyester labeling material.

Several solutions have been proposed to remedy the above detailed problems. One solution to the problem of malformed images can be simply cleaning the printhead. While it is often desirable to routinely clean the printhead, which includes thermal elements, frequent cleaning can become tedious. Further, since cleaning the printhead typically requires printing to be temporarily suspended, lack of productivity and/or inefficiency can result.

Another solution to the problem of malformed images can be purging debris from the ribbon, or "cleaning" the ribbon, using a ribbon wiper. Both external and internal ribbon wipers have been employed within thermal printers to clean a ribbon. Typically, external ribbon wipers accept ribbon dispensed from a ribbon cartridge and, when the ribbon travels upon the external ribbon wiper, the ribbon is cleaned. While external ribbon wipers may be adequate in some circumstances, they possess significant disadvantages. For example, monitoring of external ribbon wipers is typically completed independently of the monitoring of other printer components as wear on the ribbon wiper and other printer components can occur at different rates. Also, external ribbon wipers require separate maintenance and/or replacement schedules. Unfortunately, the maintenance and/or replacement schedules for external ribbon wipers seldom coincide with the maintenance and/or replacement schedules of other printer components. Thus, external ribbon wipers require extra monitoring, maintenance, and replacement. As such, the external wipers may create more difficulties than they solve.

Internal ribbon wipers can perform the same ribbon-cleaning function as external wipers, however, internal ribbon wipers are disposed within the ribbon cartridge. Internal ribbon wipers can assist in alleviating some of the problems associated with external ribbon wipers.

While both external and internal ribbon wipers can remove debris from a ribbon, the external and internal ribbon wipers known in the art possess significant disadvantages. Typically, these ribbon wipers have only been employed to clean the "ink surface" of the ribbon, the ink surface being that surface of the ribbon that possesses ink and usually faces away from the printhead during thermal contact. While these ink surface ribbon wipers may remove some debris, they fail to remove the debris from the printhead surface of the ribbon. As such, debris on the printhead surface of the ribbon continues, as described above, to interfere with thermal contact between thermal elements and the ribbon, as well as accumulate on the printhead.

Thus, a more practical and efficient method of cleaning a ribbon within a thermal printer is needed. Further, a more desirable method of keeping a printhead and/or thermal elements clean would also be preferred.

SUMMARY OF THE INVENTION

In one aspect, the invention comprises a ribbon wiper for use in a ribbon cartridge. The ribbon wiper is disposed within the ribbon cartridge and cleans a printhead surface of a ribbon.

The ribbon wiper includes a cleaning material layer for cleaning a printhead surface of a ribbon and a base material layer for supporting the cleaning material layer. An adhesive is used to secure the cleaning material layer to the base material layer and the base material layer to an internal portion of a ribbon cartridge. The printhead surface of the ribbon is cleaned when the ribbon travels upon, or is biased against, the ribbon wiper as the ribbon exits the ribbon cartridge.

The cleaning material layer of the ribbon wiper can be a woven material, a velvet, a flocked velvet, and a rayon fiber coated with acrylic polymer. The base material layer can be a foam manufactured with a thickness tolerance of less than 35 percent. In one embodiment, a label printer employs the ribbon wiper.

In one embodiment, a ribbon wiper is used within a label printer and is part of a ribbon-cleaning system. The ribbon-cleaning system includes a ribbon cartridge, a ribbon wiper secured within the cartridge, and a ribbon roller in operational association with the ribbon cartridge and the ribbon wiper. The printhead surface of the ribbon is biased against the cleaning material layer of the ribbon wiper such that the printhead surface of the ribbon is cleaned as the ribbon exits the cartridge. The cleaning material layer can inhibit accumulation of debris upon a printhead. Angles formed between the ribbon and various rollers can permit the ribbon to be biased upon the cleaning material layer of the ribbon wiper. Further, rollers can produce a tension in the ribbon that permits the cleaning material layer of the ribbon wiper to clean the printhead surface of the ribbon.

Typically, the ribbon wiper and the ribbon cartridge are simultaneously and/or concurrently replaced in the label printer. In one case, the ribbon wiper and ribbon cartridge can be replaced when the supply of ribbon within the ribbon cartridge is exhausted.

Another aspect of the invention provides a method of cleaning the ribbon in the label printer. The method comprises providing the ribbon and the ribbon wiper within the ribbon cartridge. The ribbon is dispensed from the ribbon cartridge and biased toward the ribbon wiper such that a printhead surface of the ribbon is cleaned. The ribbon can be biased upon the ribbon wiper by using various rollers.

BRIEF DESCRIPTION OF THE DRAWINGS

Embodiments of the invention are described below with reference to the accompanying drawings and are for illustrative purposes only. The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for the purpose of description and illustration and should not be regarded as limiting. Like reference numerals are used to indicate like components.

DETAILED DESCRIPTION OF THE PREFERRED EMBODIMENT

Figure 1:
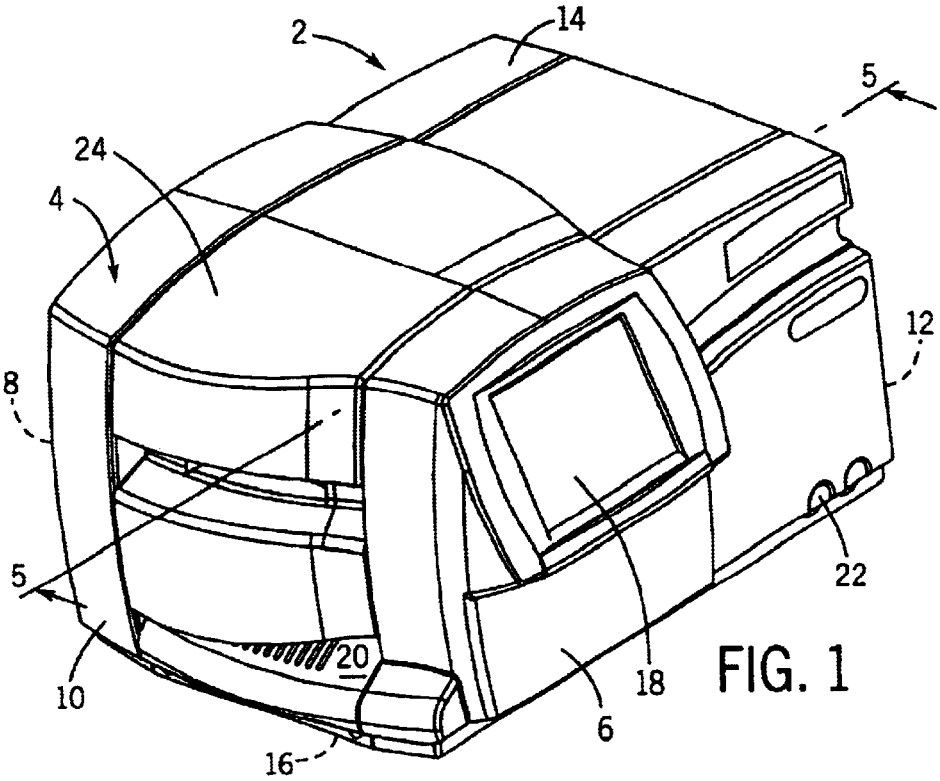
FIG. 1 illustrates a perspective view of an embodiment of a label printer-cutter in one aspect of the invention.

As shown in FIG. 1, a label printer-cutter 2 (hereinafter referred to in this application as a printer and/or a thermal printer) capable of employing the present invention is shown. Printer 2 includes a plastic housing 4 having a front 6, a back 8 (hidden), a left side 10, and a right side 12 (hidden). Printer 2 also includes a top side 14 and a bottom side 16 (hidden). Housing 4 supports a liquid crystal display (LCD) screen 18 that can be mounted to housing 4. LCD screen 18 can display printer status, error indicators, and the like, to a printer operator. One or more LCD controllers 22 can be included with printer 2 to control and/or adjust characteristics of LCD screen 18. Printed labels (not shown) are ejected from printer 2 through exit chute 20 formed within right side 12 of housing 4. Printer 2 also comprises a retractable cover 24 within top side 14 of housing 4. In FIG. 1, over 24 is depicted in the "closed" position. As such, printer 2 is configured for operation or transportation.

Figure 2:
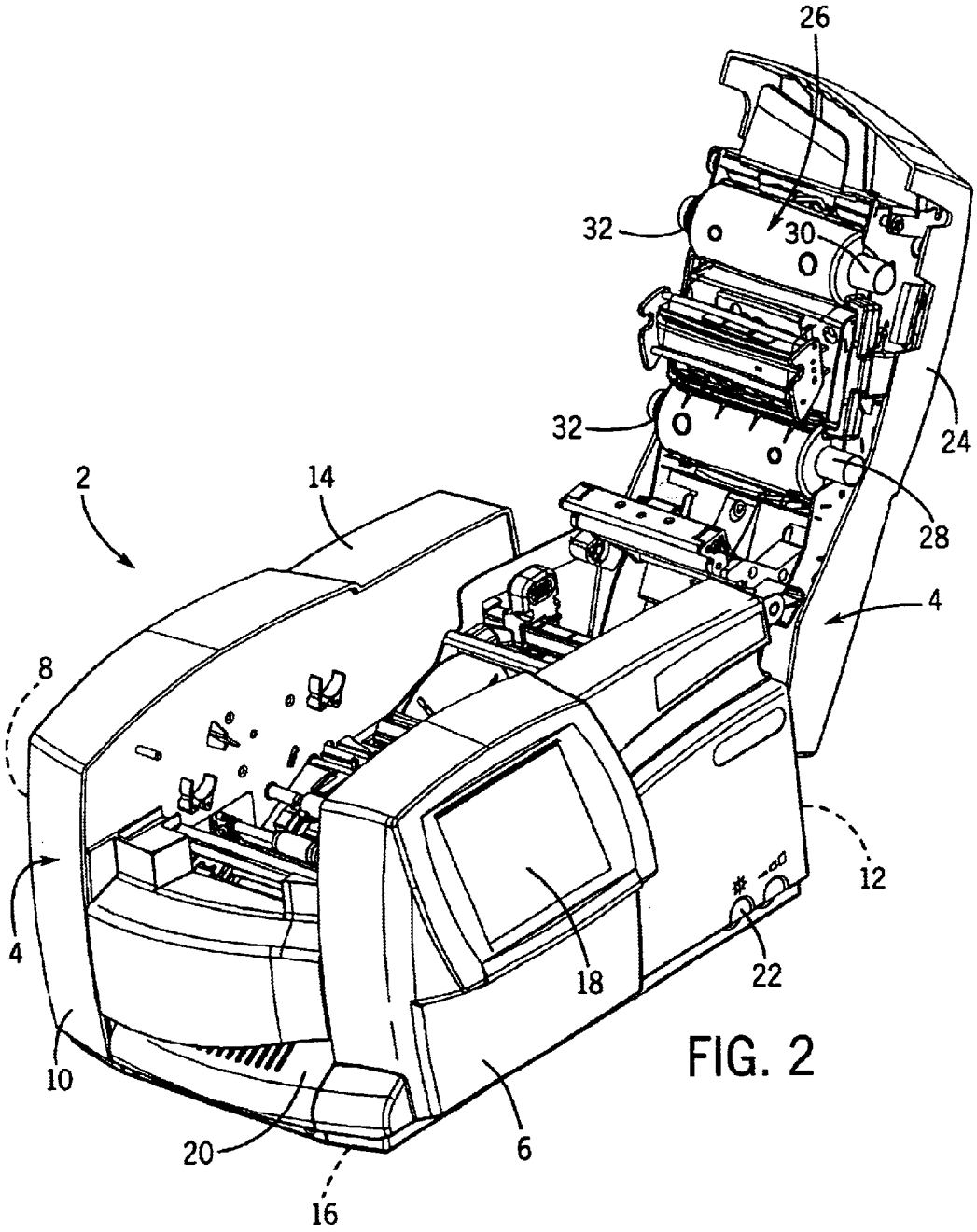
FIG. 2 illustrates a perspective view of the label printer-cutter of FIG. 1, in an open position, with a ribbon cartridge (FIG. 3) disposed therein.

Referring now to FIG. 2, printer 2 is illustrated with cover 24 in an "open" position. The open position is accomplished by releasing a temporary securing mechanism (not shown) on left side 10 of housing 4 and applying a lifting force to cover 24. The lifting force causes left side 10 of cover 24 to pivot proximate right side 12 of printer 2. As cover 24 pivots, the lifting force transforms printer 2 from the closed position (FIG. 1) to the open position (FIG. 2).

In the open position, printer 2 displays various printer subassemblies (all of which are not detailed in this application) within plastic housing 4. Printer circuitry (not shown) mounted within housing 4 can control the printer subassemblies and LCD screen 18. While in the open position, printer 2 is typically idle (i.e., not printing) and, therefore, capable of being inspected, maintained, and supplied with materials used in printing. For example, in the open position, printer 2 can receive ribbon cartridge 26 as illustrated in FIGS. 2 and 3.

Figure 3:
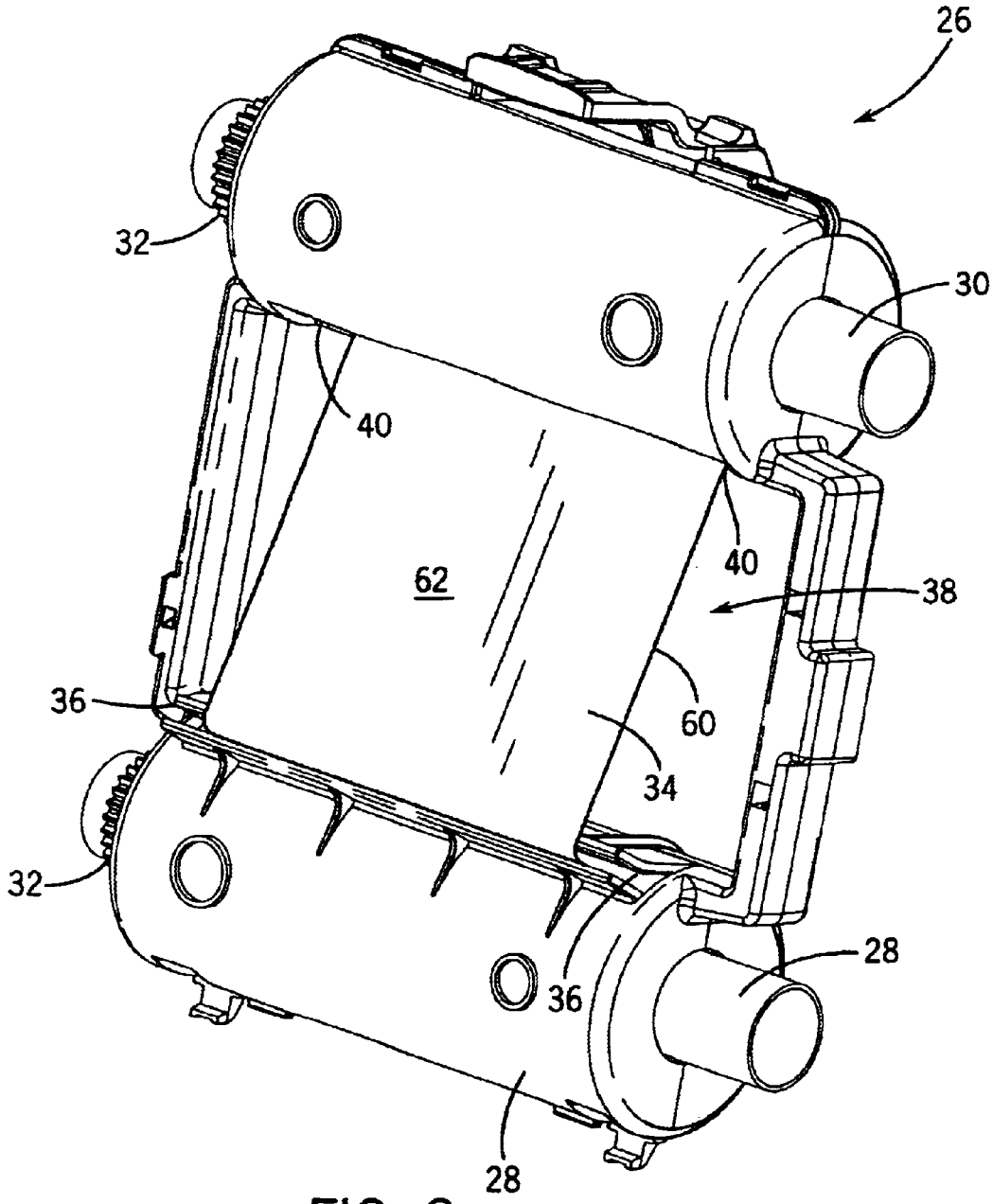
FIG. 3 illustrates a perspective view of an embodiment of the ribbon cartridge capable of being received in the label printer-cutter of FIG. 1 and used during printing in the label printer-cutter.

Ribbon cartridge 26, as depicted in FIG. 3, comprises a ribbon cartridge housing 27 that can provide an environment for a quantity or supply of ribbon 34. Ribbon cartridge 26 can include, among other things, a ribbon supply roller 28 and a ribbon take-up roller 30. Ribbon supply roller 28 and ribbon take-up roller 30 can include gears 32 disposed on a distal end of each roller. Gears 32 correspond to mating drive gears (not shown) within printer 2. Mating drive gears rotate as printer 2 operates, thereby causing gears 32, and consequently ribbon supply roller 28 and ribbon take-up roller 30, to turn.

Ribbon cartridge 26 can further include a thermally-sensitive ink ribbon 34, the ribbon typically being wound around the rollers 28, 30. As ribbon supply roller 28 turns, ribbon 34, which can be initially wound around ribbon supply roller 28, can be expelled from a ribbon-discharge slot 36 in ribbon cartridge housing 27 of ribbon cartridge 26. Thereafter, ribbon 34 can traverse a ribbon-accessible area 38 and enter a ribbon-accepting slot 40 in ribbon cartridge housing 27 of ribbon cartridge 26. Ribbon-accessible area 38 is defined as that area between ribbon discharge slot 36 and ribbon accepting slot 40. After entering ribbon-accepting slot 40, ribbon 34 can be wound upon ribbon take-up roller 30.

Figure 4:
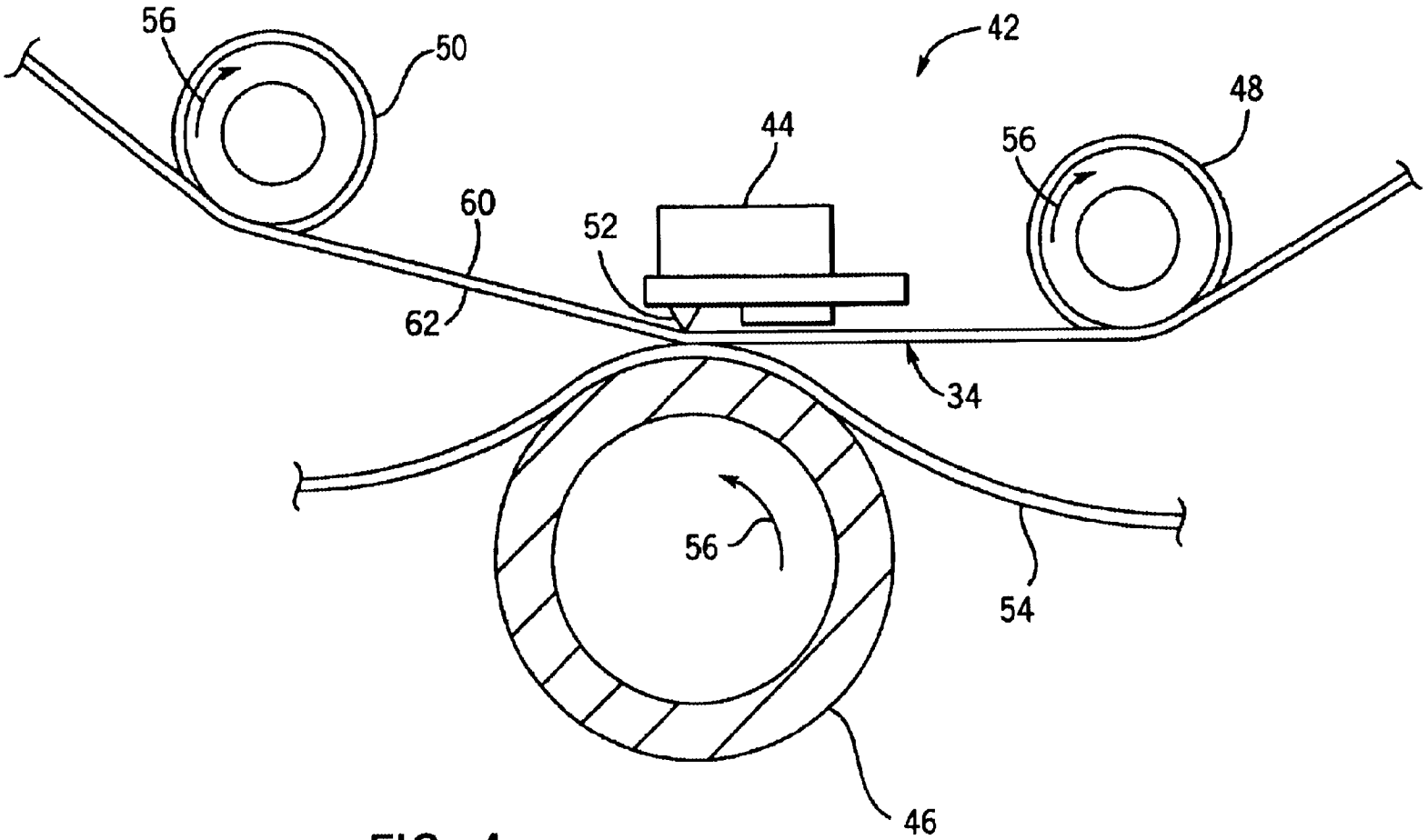
FIG. 4 illustrates a side elevational view of an embodiment of a thermal printing apparatus that can be employed by the label printer-cutter of FIG. 1.

Turning now to FIG. 4, a typical thermal printing apparatus 42 that can be used within printer 2 is illustrated. Printing apparatus 42 comprises a thermal printhead 44, a support or platen roller 46, a first ribbon roller 48, and a second ribbon roller 50. Printhead 44 can be equipped with a linear array of thermal elements 52. The number of thermal elements in the linear array can vary, with a characteristic printhead 44 employing one thousand two hundred forty-eight (1,248) thermal elements 52. Each thermal element 52 produces heat in response to energy (e.g., voltage and/or current) supplied by a microcontroller (not shown) associated with printhead 44. If enough energy is applied to thermal elements 52, ink disposed on ribbon 34 can be liquefied. If ribbon 34 comes into thermal contact with thermal elements 52 while proximate media 54, as illustrated in FIG. 4, ink on the ribbon is liquefied, the liquefied ink is transferred to the media, and dots are formed. Depending on the color of the ink on ribbon 34, the dots can comprise a multitude of colors. By arranging the pattern, intensity, and color of dots that are generated, printed images can be formed as media 54 is stepped (possibly repeatedly) past thermal elements 52 being selectively, intermittently heated. In FIG. 4, directional arrows 56 illustrate the direction of travel of the various components in printing apparatus 42.

Figure 5:
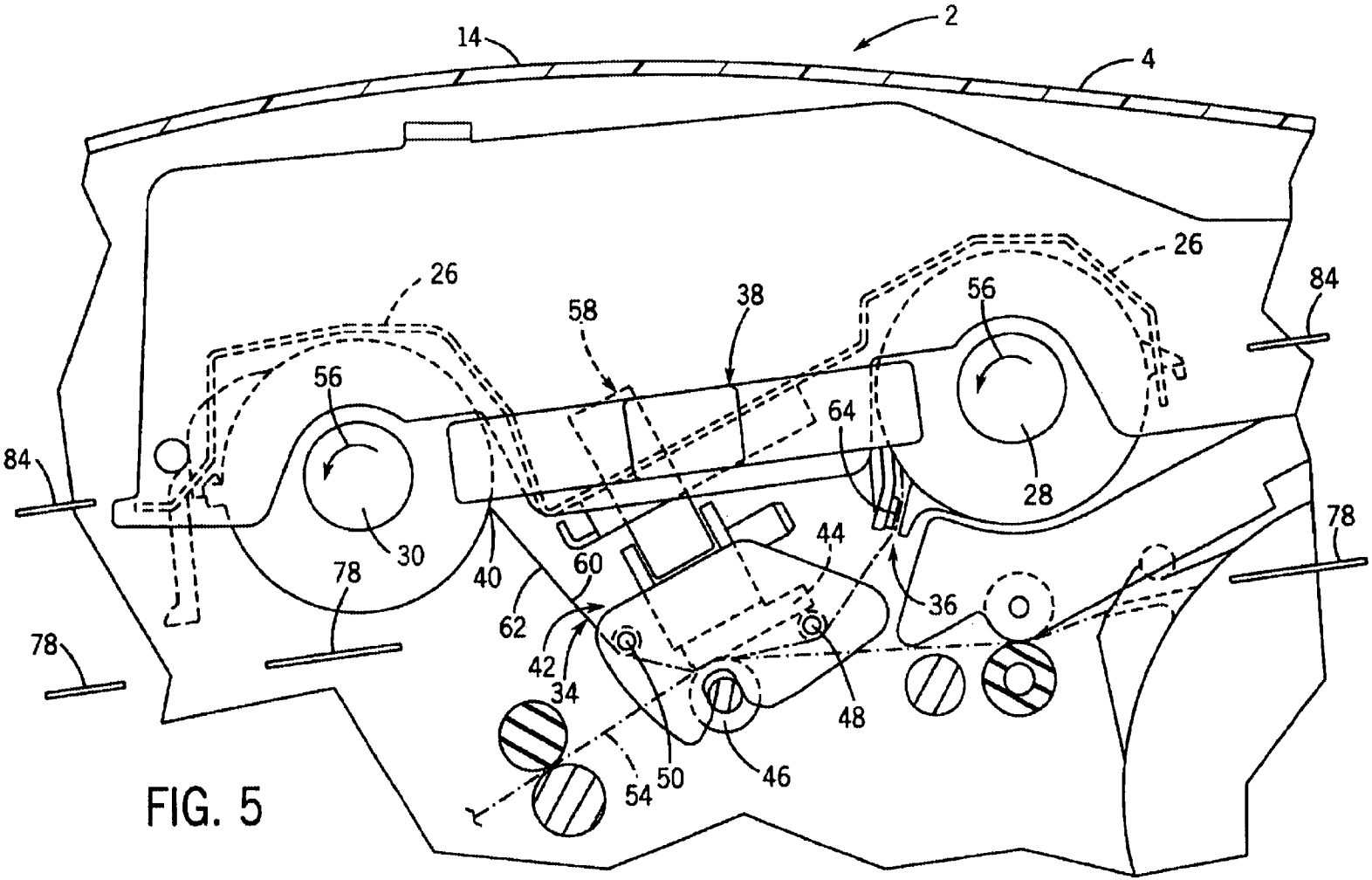
FIG. 5 illustrates a partial cross-sectional view, taken along line 5—5 of FIG. 1, of the label printer-cutter while the thermal printing apparatus of FIG. 4 is engaged with a ribbon supplied by the ribbon cartridge of FIG. 3.

Printer 2, as illustrated in FIG. 1, operates using a supply of ribbon 34. If printer 2 has not previously been loaded with a supply of ribbon 34, printer 2 is opened (e.g., FIG. 2) and ribbon cartridge 26 (FIG. 3), holding a supply or quantity of ribbon 34, is loaded into the printer. As illustrated in FIG. 2, printer 2 receives ribbon cartridge 26 and, thereafter, the printer is returned to the closed position (FIG. 1). Upon reaching the closed position, print head assembly 58 comprising printing apparatus 42 is lowered to engage ribbon 34, media 54, and platen roller 46. Thereafter, ribbon cartridge 26 discharges ribbon 34, courtesy of gears 32, while platen roller 46 is driven to feed media 54 and/or ribbon 34 past printhead 44. With printhead assembly 58 positioned as illustrated in FIG. 5, a "printing position" is achieved and printing can thereafter commence.

Unfortunately, debris (e.g., lint, dust, and/or other contaminants) can become disposed on ribbon 34. This can occur during printing, while printer 2 is being stored, during shipping of cartridges 26 carrying ribbon 34, during manufacturing of ribbon 34, while back-coating of ribbon 34 occurs, and the like. Debris can become especially troublesome if located on the "printhead surface" 60 of ribbon 34, the printhead surface being that surface on the ribbon that faces printhead 44 during thermal contact as illustrated in FIG. 5. If debris is permitted to remain on ribbon 34 during thermal printing, the debris can interfere with, hinder, and/or obstruct contact between thermal elements and the ribbon. For example, debris found on ribbon 34 can become positioned between one of the thermal elements 52 and ribbon 34. If that thermal element 52 is instructed to fire, and generate a dot, the debris can block thermal contact, impede the transfer of ink, and the like. In such an example, a misfire of the thermal element can result such that no dot, or a malformed dot, is produced. Thus, individual dots can be adversely affected.

Further, debris disposed on ribbon 34 can accumulate on printhead 44 and/or one or more thermal elements 52 as printer 2 operates such that multiple or consecutive dots are adversely affected. These accumulations can substantially interfere with the quality of a printed image produced by printer 2. As the accumulation of debris on printhead 44 increases, thermal contact between thermal elements 52 proximate the accumulation of debris and ribbon 34 can diminish. While debris continues to collect on or near printhead 44 and/or thermal elements 52, the collection of debris can effectively disable the thermal elements such that they are no longer able to generate dots. In such cases, undesired and unaesthetic "voids", "streaks", and/or "scratches" can occur within the printed image in the direction of printing. These voids can be especially apparent on polyester labeling material.

Figure 6:
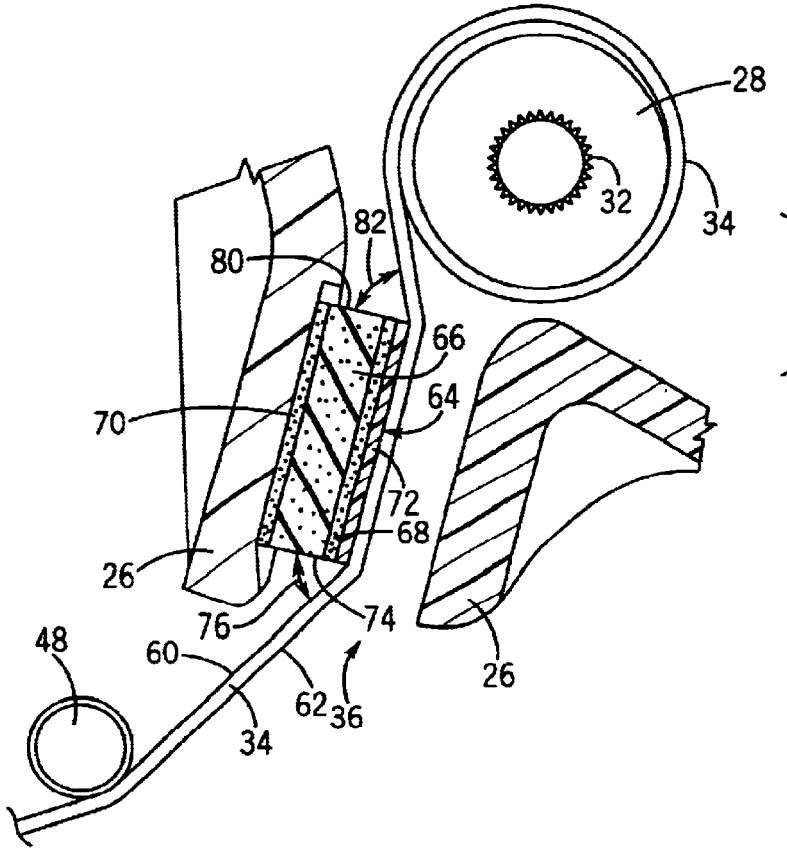
FIG. 6 illustrates a partial cross-sectional view of the ribbon cartridge of FIG. 3, the ribbon cartridge incorporating an internal ribbon wiper according to one aspect of the invention.

As illustrated in FIG. 3, ribbon cartridge 26 can further comprise ribbon wiper 64. Ribbon wiper 64, as highlighted in FIG. 6, can be secured to ribbon cartridge 26 to clean the debris from printhead surface 60 of ribbon 34. In preferred embodiments, ribbon cartridge 26 comprises ribbon cartridge housing 27 that defines an interior 29 (partially illustrated in FIG. 6) of the ribbon cartridge. In these embodiments, ribbon wiper 64 can be secured to the ribbon cartridge housing 27 of ribbon cartridge 26 such that the ribbon wiper is disposed within interior 29 of the ribbon cartridge, as illustrated in FIG. 6. Thus, ribbon wiper 64 can therefore be referred to as an "internal" ribbon wiper. Ribbon wiper 64 is typically secured to ribbon cartridge housing 27, within interior 29, proximate ribbon discharge slot 36.

Cleaning, as used herein, is defined as the removal of debris (e.g., dust, lint, and/or other contaminants) from ribbon 34. In one embodiment, cleaning is performed by "wiping" ribbon 34 free of debris by passing the ribbon over, and upon, ribbon wiper 64. As such, ribbon wiper 64 can clean ribbon 34 as printing occurs. As ribbon 34 travels upon ribbon wiper 64, and passes the ribbon wiper, debris is swept clear of printhead surface 60. Therefore, when ribbon 34 reaches printhead 44 (FIG. 4), the ribbon is cleaned or substantially cleaned. While a ribbon wiper can be configured to clean both ink surface 62 and printhead surface 60 of ribbon 34, in preferred embodiments, cleaning is conducted on the printhead surface of the ribbon.

Removal of the entire amount of debris from ribbon 34 is desirable, however, substantially cleaning ribbon 34, and particularly the printhead surface 60 of the ribbon, can be acceptable. As used herein, substantially cleaning is defined, in preferred embodiments, as the removal of about 90% to about 94% of the debris disposed on the printhead surface 60 of ribbon 34. In more preferred embodiments, substantially cleaning is defined as the removal of about 94% to about 98% of the debris disposed on the printhead surface 60 of ribbon 34. In even more preferred embodiments, substantially cleaning is defined as the removal of about 98% to about 100% of the debris disposed on the printhead surface 60 of ribbon 34.

As illustrated in FIG. 6, ribbon wiper 64 comprises a base material layer 66, a first adhesive 68, and a cleaning material layer 72. Base material layer 66 comprises and defines a base material front surface 67 and a base material rear surface 69. Base material layer 66 can comprise a variety of flexible and/or compressible materials (e.g., a foam). In a preferred embodiment, base material layer 66 comprises VOLARA brand mini-cell L-200 foam that is available from Reilly Foam Corporation, Inc., of Conshohocken, Pa. In one embodiment, base material layer 66 comprises a 0.125-inch-thick layer of material. Ribbon wiper 64 can be assembled by securing cleaning material layer 72 to base material front surface 67 of base material layer 66 using first adhesive 68. In this manner, ribbon wiper 64 can be constructed according to one aspect of the invention. Thereafter, ribbon wiper 64 can be secured and/or attached to ribbon cartridge 26 using a second adhesive 70 applied to base material rear surface 69 as illustrated in FIG. 6.

Both first and second adhesives 68, 70 can comprise a variety of adhesives. For example, in preferred embodiments, first and second adhesives 68, 70 comprise a pressure-sensitive adhesive. In one preferred embodiment, first and second adhesives 68, 70 comprise a 0.5 Mil (about 12 microns) double-coated universal foam laminating industrial tape such as Product No. 3680 available from the Venture Tape Corporation, Inc., of Rockland, Md. While first and second adhesives 68, 70 can be the same in one embodiment, there is no requirement that the adhesives be identical. Further, first and second adhesives 68, 70 can each be employed in a variety of configurations such as a strip of adhesive, a layer of adhesive, and the like.

Cleaning material layer 72 can comprise a woven material (e.g., a flocked velvet, a velvet, and the like). In a preferred embodiment, cleaning material layer 72 comprises a die-cut layer of soireé material available from Charles W. Fifield, Jr., Company, Inc. of Hingham, Mass. Soireé material comprises flock disposed on a rayon back (21.1% nylon flock, 44.2% rayon, 34.7% adhesive). In another preferred embodiment, base material layer 66 comprises a rayon fiber coated with an acrylic polymer such as ULTRAWIPE 532 available from Minnesota Mining and Manufacturing Corporation of St. Paul, Minn. In one preferred embodiment, cleaning material layer 72 comprises a 4.1 inch by 0.25 inch layer of material.

As illustrated in FIG. 6, since ribbon wiper 64 is disposed within cartridge 26, the ribbon wiper need not be monitored or inspected by the printer operator or printer 2. This benefit is available because ribbon wiper 64, in preferred embodiments, can be discarded (i.e., thrown away, disposed of) when the supply of ribbon within cartridge 26 is exhausted. Ribbon wiper 64 is changed or replaced, and a new ribbon wiper installed, each time a new supply of ribbon 34 (i.e., a new cartridge 26) is inserted into printer 2. Therefore, ribbon wiper 64 generally requires little, if any, maintenance.

In another embodiment, ribbon wiper 64 can continue to be used after an original (e.g., first) supply of ribbon within cartridge 26 is exhausted. In these embodiments, a subsequent (e.g., second and/or fresh) supply of ribbon is inserted and/or employed within cartridge 26 to replace the first supply and the original ribbon wiper 64 is once again used. Therefore, cartridge 26 can be known as, for example, a refillable, reusable, or recyclable cartridge.

Still referring to FIG. 6, ribbon wiper 64 comprises a first side surface 74 which defines a first angle 76 formed between the first side surface and ribbon 34. As illustrated in FIGS. 5 and 6, first angle 76 can be adjusted (i.e., increased or decreased) by moving first ribbon roller 48, for example, along ribbon roller plane 78 (FIG. 5). It has been found that the ability of ribbon wiper 64 to effectively clean ribbon 34 can directly correspond to first angle 76. Further, the ability of printer 2 to even function properly can also directly correspond to first angle 76. For example, if first angle 76 is too great (e.g., first ribbon roller 48 is moved too far toward ribbon supply roller 28 along a ribbon roller plane 78) ribbon 34 is not biased against ribbon wiper 64. As such, ribbon wiper 64 can fail to adequately remove debris. Conversely, if first angle 76 is too small (e.g., first ribbon roller 48 is moved too far away from ribbon supply roller 28 along ribbon roller plane 78) ribbon 34 can be biased against ribbon wiper 64 with such force (e.g., a friction force) that gears 32 cannot drive the ribbon through printer 2. Notably, first ribbon roller 48 can be moved in a manner other than along ribbon roller plane 78 and still have the effects similar to those described above. In preferred embodiments, first angle 76 is between about 68 degrees and about 78 degrees.

Also, as illustrated in FIG. 6, ribbon wiper 64 comprises a second side surface 80 which defines a second angle 82 formed between the second side surface and ribbon 34. As illustrated in FIGS. 5 and 6, second angle 82 can be adjusted (i.e., increased or decreased) by moving ribbon supply roller 28, for example, along ribbon supply roller plane 84 (FIG. 5). The ability of ribbon wiper 64 to effectively clean ribbon 34 can directly correspond to second angle 82. Further, the ability of printer 2 to even function properly can directly correspond to second angle 82. For example, if second angle 82 is too great (e.g., ribbon supply roller 28 is moved too far away from ribbon wiper 64 along a ribbon supply roller plane 84) ribbon 34 is not biased against ribbon wiper 64. As such, ribbon wiper 64 can fail to remove debris. Conversely, if second angle 82 is too small (e.g., ribbon supply roller 28 is moved too far past ribbon wiper 64 along ribbon supply roller plane 84) ribbon 34 can be biased against ribbon wiper 64 with such force (e.g., a friction force) that gears 32 cannot drive the ribbon through printer 2. Notably, ribbon supply roller 28 can be moved in a manner other than along ribbon supply roller plane 84 and still have the effects similar to those described above. In preferred embodiments, second angle 82 is between about 72 degrees and about 89 degrees.

The thickness of a foam layer used within a ribbon wiper can vary depending on the thickness tolerance adopted during the foam manufacturing process. During the foam manufacturing process, the thickness tolerance for most foams can be approximately 35% (more or less). In other words, the foam manufacturing process can possess almost a 35% margin of error when attempting to achieve a desired foam thickness. If a foam with too great a foam tolerance is used within a ribbon wiper, the ribbon can be biased either too forcefully, or not forcefully enough, upon a ribbon wiper. Resultantly, the cleaning performance of the ribbon wiper can vary depending on the thickness tolerance maintained while manufacturing the foam. Thus, in preferred embodiments, the foam used within the ribbon wiper is manufactured with a thickness tolerance of about 10% (more or less). By controlling and/or limiting thickness tolerance, variation in cleaning performance can be diminished and a more consistent desired thickness maintained.

In one embodiment, ribbon 34 can be biased against ribbon wiper 64 using first ribbon roller 48 to provide a tension to ribbon 34, as opposed to using first ribbon roller 48 to control first angle 76. For example, as printhead assembly 58 engages ribbon 34 as illustrated in FIG. 5, first ribbon roller 48 contacts the ribbon, and thereafter biases the ribbon generally in the direction of platen roller 46. Optionally, gear 32 on ribbon supply roller 28 can temporarily prevent or limit release of further ribbon 34. As this occurs, first ribbon roller 48 effectively provides tension to ribbon 34. Tension in ribbon 34 acts to assist in biasing ribbon 34 against ribbon wiper 64.

In another embodiment, ribbon 34 can be biased against ribbon wiper 64 using second ribbon roller 50 to provide tension in the ribbon. As printhead assembly 58 engages ribbon 34 as illustrated in FIG. 5, second ribbon roller 50 contacts the ribbon, and thereafter biases the ribbon toward platen roller 46. Optionally, gear 32 on ribbon supply roller 28 can temporarily prevent or limit release of further ribbon 34. As this occurs, second ribbon roller 50 effectively provides tension to ribbon 34. Tension in ribbon 34 acts to assist in biasing ribbon 34 against ribbon wiper 64.

In yet another embodiment, using ribbon take-up roller 30, tension can be supplied to ribbon 34 to bias the ribbon against ribbon wiper 64. If ribbon take-up roller 30 is advanced using gear 32, tension will be added to the ribbon. Optionally, ribbon supply roller 28 can temporarily deny or limit release of further ribbon 34. As previously stated, tension in ribbon 34 can act to assist in biasing ribbon 34 against ribbon wiper 64. In preferred embodiments, first ribbon roller 48, second ribbon roller 50, and/or ribbon take-up roller 30, alone or in combination with one another, can produce tension in ribbon 34 such that the ribbon is urged against, or upon, ribbon wiper 64.

In a printing system using one embodiment of the invention, ribbon cartridge 26 with a specific supply of ribbon 34 is loaded into printer 2. The processor (not shown) in printer 2 prepares printing instructions that are sent to a microcontroller (not shown). The microcontroller is that device which provides thermal elements 52 with pulses of energy (i.e., microstrobes). The microcontroller accepts the printing instructions from the processor and orchestrates delivery of energy during microstrobes, resulting in the subsequent firing of thermal elements 52 disposed on printhead 44. As thermal elements 52 fire, thermal contact between the thermal elements and thermally-sensitive ribbon 34 takes place, and ink is transferred in the form of dots, onto media 54. Thus, a printed image (not shown) can be created on media 54.

Printer 2, as illustrated in FIG. 1, can further comprise a keyboard, a mouse, and the like, for accessing, inputting, and displaying information used in the printing system. Further, ribbon cartridge 26 can be ergonomically designed to compliment the hand of the operator of the printer.

It is contemplated that one or more ribbon wipers 64 can be employed within ribbon cartridge 26. It is further contemplated, that one or more ribbon wipers 64 can be utilized to clean not only the printhead surface, but ink surface 62 of ribbon 34 as well.

Even though the invention is described in terms of a ribbon and a ribbon cartridge, other substrates and substrate containers (e.g., a media and media cartridge) are contemplated and considered within the scope of the invention. For example, a media wiper (possibly internal to a media cartridge) can be employed to clean a media supplied by a media cartridge within a printer. Also, while the invention herein is generally directed to a thermal printing process, embodiments of the present invention can include, but are not limited to, a thermal wax-transfer process, a thermal dye-diffusion process, or a direct thermal-transfer process. In the direct thermal-transfer embodiment, no ribbon, or accompanying ribbon delivery and take up roller, is used. The thermal printhead presses directly against a thermally reactive media while the platen roller rotates to drive the media past the thermal printhead. Therefore, another substrate, such as a media, can be cleaned in direct thermal printing. Also, embodiments of the invention can include, but are not limited to, other types of printing, including non-thermal printing.

Despite any methods being outlined in a step-by-step sequence, the completion of acts or steps in a particular chronological order is not mandatory. Further, elimination, modification, rearrangement, combination, reordering, or the like, of acts or steps is contemplated and considered within the scope of the description and claims.

While the present invention has been described in terms of the preferred embodiment, it is recognized that equivalents, alternatives, and modifications, aside from those expressly stated, are possible and within the scope of the appending claims.

What is claimed is:

1. A ribbon wiper for use in a ribbon cartridge, the ribbon cartridge comprising a ribbon cartridge housing defining an interior, the ribbon wiper comprising:

a debris cleaning material layer for cleaning a printhead surface of a ribbon disposed within the interior;

a base material layer for supporting the debris cleaning material layer, the base material layer having a front surface and a rear surface; and a first adhesive for securing the debris cleaning material layer to the front surface of the base material layer, thereby forming the ribbon wiper;

wherein the rear surface of the base material is securable to die housing within the interior such that the printhead surface of the ribbon is cleaned as the ribbon exits the interior, and wherein the base material layer comprises a foam manufactured with a thickness tolerance of less than 35 percent.

2. The ribbon wiper of claim 1, wherein the debris cleaning material layer is a material selected from a group consisting of a woven material, a velvet, a flocked velvet, and a rayon fiber coated with acrylic polymer.

3. The system of claim 1, wherein the debris cleaning material layer inhibits accumulation of debris upon a printhead.

4. A ribbon wiper for use in a ribbon cartridge, the ribbon cartridge comprising a ribbon cartridge housing defining an interior, the ribbon wiper comprising;

a debris cleaning material layer for cleaning a printhead surface of a ribbon disposed within the interior;

a base material layer for supporting the debris cleaning material layer, the base material layer having a front surface and a rear surface; and a first adhesive for securing the cleaning material layer to the front surface of the base material layer, thereby forming the ribbon wiper;

wherein the rear surface of the base material is securable to the housing within the interior such that the printhead surface of the ribbon is cleaned as the ribbon exits the interior, and wherein a second adhesive secures the rear surface of the base material layer to the housing, and at least one of the first and second adhesives comprises a pressure-sensitive adhesive.

5. The ribbon wiper of claim 4, wherein the debris cleaning material layer cleans the printhead surface of the ribbon when the printhead surface of the ribbon is biased upon the debris cleaning material layer.

6. The ribbon wiper of claim 4, wherein a first angle is formed between a first side surface of the ribbon wiper and the ribbon, the angle permitting the ribbon wiper to clean debris from the ribbon.

7. A ribbon cartridge for use in a label printer comprising:

a ribbon cartridge housing, the ribbon cartridge housing defining an interior; and a ribbon wiper secured within the interior, the ribbon wiper comprising.

a debris cleaning material layer for cleaning a printhead surface of a ribbon disposed within the interior;

a base material layer for supporting the debris cleaning material layer, the base material layer having a front surface and a rear surface; and a first adhesive for securing the cleaning material layer to the front surface of the base material layer, thereby forming the ribbon wiper:

wherein the rear surface of the base material is securable to the housing within the interior such that the printhead surface of the ribbon is cleaned as the ribbon exits the interior; and wherein the base material layer comprises a foam manufactured with a thickness tolerance of less than 35 percent.

8. The ribbon cartridge of claim 7, wherein the cleaning is accomplished by biasing the printhead surface upon a debris cleaning material layer of the ribbon wiper.

9. A ribbon cleaning system for use in a label printer comprising:

a ribbon wiper, the ribbon wiper comprising a cleaning material layer secured to a front surface of a base material layer with a first adhesive;

a ribbon cartridge, the ribbon cartridge comprising a ribbon cartridge housing, the ribbon cartridge housing defining an interior, the interior having a rear surface of the base material layer of the ribbon wiper secured thereto with a second adhesive;

a thermally-sensitive ink ribbon for generating dots on a media, the thermally-sensitive ink ribbon comprising a printhead surface and being disposed within the interior of the ribbon cartridge housing;

a first ribbon roller, the first ribbon roller being in operational association with the ribbon cartridge and receiving the thermally-sensitive ink ribbon discharged from the ribbon cartridge housing; and a printhead, the printhead being in operational association with the ribbon cartridge and the thermally-sensitive ink ribbon, the thermally-sensitive ink ribbon being placed in thermal contact with the printhead to generate the dots on the media;

wherein the first ribbon roller biases the thermally-sensitive ink ribbon such that the printhead surface of the thermally-sensitive ink ribbon travels upon the cleaning material layer of the ribbon wiper prior to the thermally-sensitive ink ribbon coming into thermal contact with the printhead, thereby cleaning the printhead surface of the thermally-sensitive ink ribbon.

10. The system of claim 9, wherein the system further comprises a second ribbon roller and a ribbon take-up roller, at least one of the second ribbon roller and the ribbon take-up roller biasing the ribbon upon the debris cleaning material layer of the ribbon wiper such that the printhead surface of the ribbon is cleaned of debris.

11. The system of claim 9, wherein the first ribbon roller produces a tension in the ribbon, the tension permitting the debris cleaning material layer of the ribbon wiper to clean the printhead surface of the ribbon.

12. The system of claim 9, wherein the system further comprises a second ribbon roller and a ribbon take-up roller, at least one of the second ribbon roller and the ribbon take-up roller providing the ribbon with a tension, the tension permitting the debris cleaning material layer of the ribbon wiper to clean debris from the printhead surface of the ribbon.

13. The system of claim 9, wherein a first angle formed between the ribbon and the first ribbon roller and a second angle formed between the ribbon and a ribbon supply roller concurrently permit the ribbon to be biased upon the debris cleaning material layer of the ribbon wiper such that the printhead surface of the ribbon is cleaned.

14. The system of claim 9, wherein the cleaning material layer of the ribbon wiper inhibits accumulation of debris on the printhead.

15. The system of claim 9, wherein the cleaning material layer of the ribbon wiper prevents one or more undesired results in a printed image selected from the group consisting of streaks, voids, and scratches.

16. The system of claim 9, wherein a subsequent supply of the thermally-sensitive ink ribbon is inserted within the ribbon cartridge housing to replace a first supply of the thermally-sensitive ink ribbon within the ribbon cartridge housing when the first supply is exhausted.

17. A substrate cleaning system for use in a label printer comprising:

a substrate, a substrate wiper having a debris cleaning material layer for cleaning debris from the substrate; and a substrate cartridge containing the substrate and having the substrate wiper secured therein, the substrate cartridge having a substrate discharge slot, a substrate accepting slot, and a substrate accessible, non-substrate contacting area located between the substrate discharge slot and the substrate accepting slot;

wherein the substrate is biased toward the substrate wiper such that the substrate travels upon the substrate wiper, the substrate wiper cleaning the substrate of debris.

18. The substrate cleaning system of claim 17, wherein the biasing is accomplished by at least one of a first substrate roller, a second substrate roller, a substrate take-up roller, and a substrate supply roller.

19. The substrate cleaning system of claim 17, wherein the substrate cartridge further comprises a discharge slot, the substrate being dispensed proximate the discharge slot.

20. The substrate cleaning system of claim 17, wherein the substrate is cleaned by wiping a printhead surface of the substrate with a debris cleaning material layer of the substrate wiper.

* * * * *